United States Patent [19]

Bosslet et al.

[11] 3,958,892

[45] May 25, 1976

[54] VIBRATORY GROUND ROLLER

[75] Inventors: Adolf Bosslet, Halsenbach; Jost Schieche, Baunatal; Hans Scharenberg, Udenhausen; Gulertan Vural, Emmelshausen; Herbert Roos, Morshausen, all of Germany

[73] Assignee: Koehring GmbH, Boppard, Rhine, Germany

[22] Filed: Sept. 9, 1974

[21] Appl. No.: 504,552

[30] Foreign Application Priority Data

Sept. 8, 1973 Germany ..... 2345411

[52] U.S. Cl. ..... 404/117; 404/123

[51] Int. Cl.[2] ..... E01C 19/38

[58] Field of Search ..... 404/117, 122, 128, 123

[56] References Cited

UNITED STATES PATENTS

| | | | |
|---|---|---|---|
| 2,127,485 | 8/1938 | Owens | 404/123 |
| 2,682,153 | 6/1954 | Fink | 404/122 X |
| 2,812,696 | 11/1957 | Henry | 404/117 |
| 2,830,511 | 4/1958 | Wills | 404/128 X |
| 3,176,597 | 4/1965 | Seaman | 404/117 |
| 3,422,735 | 1/1969 | Vitry | 404/117 |
| 3,861,475 | 1/1975 | Kuncewicz | 404/117 X |

*Primary Examiner*—Nile C. Byers, Jr.

*Attorney, Agent, or Firm*—Spencer & Kaye

[57] ABSTRACT

A vibratory ground roller composed of a main frame carrying a plurality of rolling drums one in front of the other and a steering frame attached to the back of the main frame has the steering frame connected to the main frame by a plurality of links forming a pivoted link system each link of which is pivotally connected at its front end to the main frame and its back end to the steering frame and the system is so arranged that when the main frame pitches, the resulting horizontal movements of the pivots of the rear ends of the links to the steering frame are at least substantially equal to each other.

5 Claims, 3 Drawing Figures

VIBRATORY GROUND ROLLER

BACKGROUND OF THE INVENTION

This invention relates to vibratory ground rollers of the kind having parallel rolling drums which are rotatably mounted in bearings in a main frame to which a steering frame provided with a seat for an operator is attached.

In one such vibratory ground roller, the main frame, in which the rolling drums rotate, has an extension at one end provided with a pin to which the steering frame is attached. The steering frame has wheels on a pivoted member acted upon by a pre-stressed hydraulic piston. The operator has to walk along by the side of the roller, which he steers by manipulating a handle on the steering frame. Control of the roller is tiring for the operator, particularly on uneven ground. In another known vibratory ground roller the steering frame has a seat for the operator. This makes his task easier and improves his control of the roller. However, all vibratory ground rollers have oscillation exciters which give the main frame, with its rolling drums, a pitching oscillation centered on the center of gravity of the main frame and the parts which it carries. Superimposed on the pitching oscillation there are further pitching movements produced by uneven ground and obstructions. The regular and irregular pitching movements of the main frame are transmitted through linkage connections to the steering frame, and consequently the operator, sitting on the steering frame, is subjected not only to vertical, that is to say heaving movements, but also to pitching movements.

SUMMARY OF THE INVENTION

The object of the present invention is to provide a vibratory ground roller of the kind described which is simple to construct and requires little maintenance and in which pitching movements of the main frame, with its rolling drums, are not, or not appreciably transmitted to the steering frame on which the operator sits. To this end, according to this invention, in such a roller the steering frame is attached to the main frame by a system of pivoted links, each link being pivotally connected at its front end to the main frame and at its back end to the steering frame, the system of links being arranged so that, when the main frame pitches, the resulting horizontal movements of the pivots of the rear ends of the links to the steering frame are at least substantially equal to each other.

In a preferred embodiment of the invention, two lower links of the system are pivoted at their front end to the main frame at a point lower than the center of gravity of the main frame and the parts which it carries and are pivoted at their back end at substantially the same height to the steering frame, and an upper link is pivoted at its front end to the main frame at substantially the same level as the said center of gravity and slopes upward to its rear end where it is pivoted to the steering frame. This reduces to a minimum the horizontal movements of the pivots of the links on the steering frame. These pivots move in the same direction and through approximately the same distances as each other. Consequently the pitching movements of the main frame do not produce pitching movements in the steering frame.

A particularly robust and twist-free linkage is obtained by an arrangement in which the linkage system is composed of two pairs of links, each pair consisting of an upper link and a lower link. The pairs of links are preferably arranged one at each side of the roller.

A further characteristic of the invention is that the links are acted upon by means which provides a force on them in the direction of that produced by the load applied to them in use. This can be done in a particularly simple and maintenance-free manner by applying torsion springs to the links near their pivots.

BRIEF DESCRIPTION OF THE DRAWING

An example of a vibratory ground roller constructed in accordance with the invention is illustrated in the accompanying drawings in which.

DESCRIPTION OF THE PREFERRED EMBODIMENTS

Figure 1:
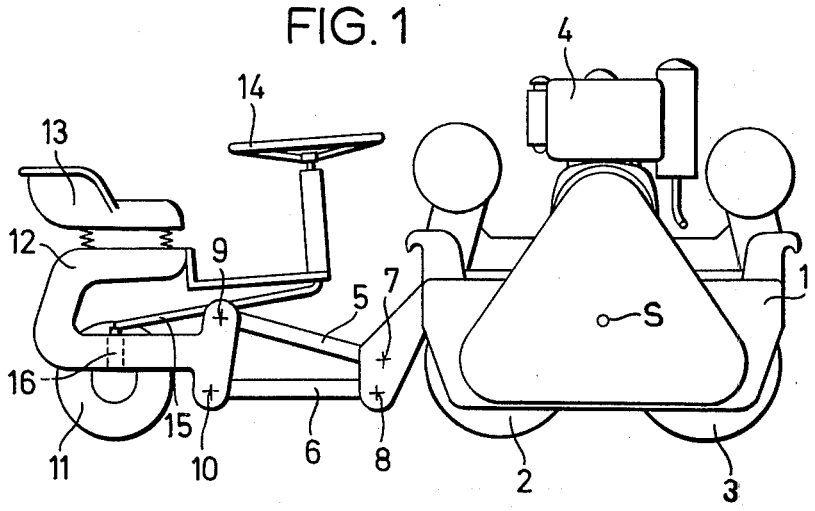
FIG. 1 is a diagrammatic side view of the vibratory ground roller.
Figure 3:
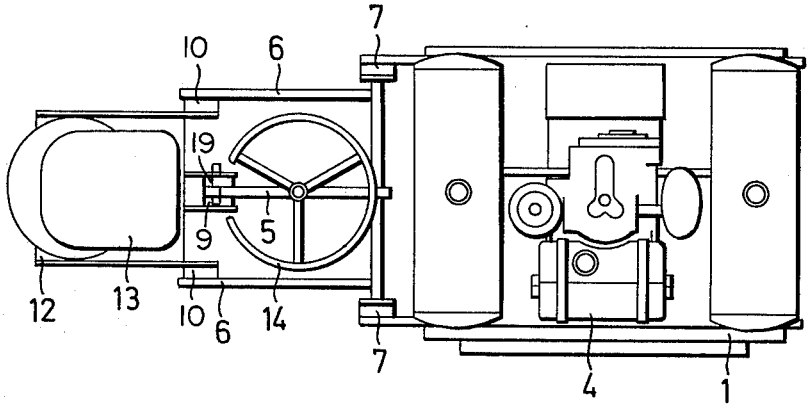
FIG. 3 is top plan view of the vibratory ground roller.

As shown in FIGS. 1 and 3, a main frame 1 of the vibratory ground roller supports two parallel rolling drums 2 and 3 which are rotatably mounted in bearings and are driven by a motor 4. Each rolling drum is provided with an oscillation exciter which is not shown in the drawing. A steering frame 12 is connected to the main frame 1 by upper and lower links, the upper link 5 being pivoted to the main frame by pivots 7 and to the steering frame by a pivot 9. The lower links 6 are pivoted to the main frame by pivots 8 and to the steering frame by pivots 10. The steering frame 12 has a steering tail wheel 11 which is pivoted on a vertical axle 16 and can be steered through a control rod 15 by an operator sitting on a seat 13 and manipulating a steering wheel 14. Some or all of the links may be provided at their pivots with torsion springs, such as spring 19 at link 9.

When the machine is in operation, the oscillation exciters cause the main frame 1 to oscillate with a pitching motion about the center of gravity S of the main frame and the parts which it carries. It is desired to prevent, as far as possible, the pitching oscillation of the main frame 1 from being transmitted to the steering frame 12. For this purpose the front pivots 8 of the lower links 6 are situated at a lower level than the center of gravity S, and the lower links6 extends backwards approximately horizontally to their rear pivots 10 on the steering frame 12. The front pivots 7 of the upper link 5 are approximately at the same height as the center of gravity S, and the upper link 5 slopes upwards and rearwards to its back pivot 9 on the steering frame 12.

Figure 2:
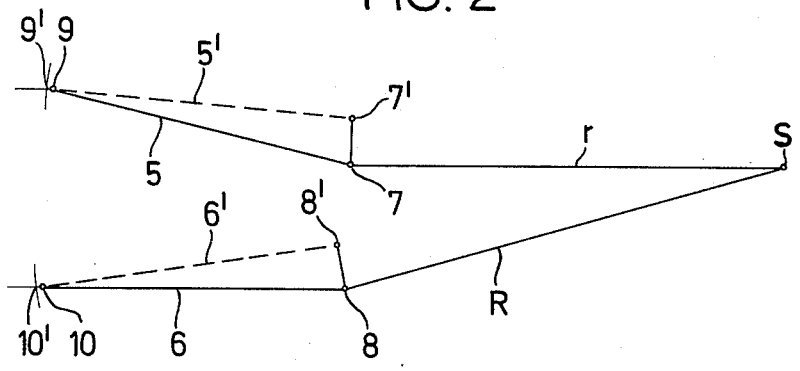
FIG. 2 is a geometrical diagram showing the displacements of the pivot points of the linkage connecting the main and steering frames when the main frame is pitching, the diagram being intended to illustrate the principles involved.

FIG. 2 illustrates the displacements of the four pivots 7, 8, 9 and 10 when the main frame 1, starting from a horizontal position, pitches forwards about its center of gravity S. The front pivots 7, rotating on a radius r, move upwards to 7'; the back pivot 9 moves backwards a short distance to 9'; the upper link 5 rises to the position 5', the length of the link of course remaining constant. The lower links 6 swing upwards into a position 6'; the front pivot 8 moves upwards rotating on a radius R to 8'; the back pivots 10 move backwards through a short distance to 10', the length of the links 6 of course remaining constant .

From FIG. 2 it will be seen that the two distances 9 – 9′ and 10 –0 10′ are substantially the same as each other, the two sets of pivots 9 and 10 moving backwards in the same direction. The steering frame 12 therefore merely moves backwards with a linear motion through a short distance. When the main frame 1 returns to the horizontal position, rotating about its center of gravity S, the steering frame 12 merely moves forwards again with a linear motion through a short distance.

Pitching movements of the main frame due to uneven ground, in which the pitching takes place about one or other of the rolling drums 2, 3 produce very similar effects, because only a little difference between heights results due to the preponderant drum weight.

We claim:

1. A vibratory ground roller comprising a main frame, a plurality of rolling drums, bearing means rotatably mounting said rolling drums in said main frame one in front of the other and with the axes thereof parallel, a steering frame, an operator seat on said steering frame, a plurality of links including at least one lower link and at least one upper link forming a pivoted link system connecting said steering frame to said main frame behind said axes of said rolling drums, first connecting means situated at a point lower than the center of gravity of said main frame and pivotally connecting the front end of said lower link to said main frame, second connecting means situated at substantially the same height as said first connecting means and pivotally connecting the back end of said lower link to said steering frame, third connecting means situated at substantially the same level as the center of gravity of said main frame and pivotally connecting the front end of said upper link to said main frame, and fourth connecting means situated at a point higher than said third connecting means and pivotally connecting the back end of said upper link to said steering frame, so that said upper link slopes upwardly from its front end to its back end, said limbs and said pivotal connecting means being so arranged that when said main frame pitches, the resulting horizontal movements of said pivotal connecting means of said back ends of said links to said steering frame are at least substantially equal to each other.

2. A vibratory ground roller as claimed in claim 1, wherein said system comprises two pairs of links, each of said pairs consisting of an upper link and a lower link.

3. A vibratory ground roller as claimed in claim 1, further comprising means acting on said links to bias said link for rotation in the same direction as rotation produced on said links by forces applied to them in operation of said roller.

4. A vibratory ground roller as claimed in claim 3, wherein said biassing means comprises torsion springs acting on said links adjacent said means pivotally connecting said links to said frames.

5. A vibratory ground roller as defined in claim 1 wherein there are two of said lower links.

* * * * *